United States Patent [19]

Connolly et al.

[11] Patent Number: 5,052,852

[45] Date of Patent: Oct. 1, 1991

[54] CONCRETE KEYED JOINTS

[75] Inventors: Paul F. Connolly; John N. Flint, both of Casino, Australia

[73] Assignees: Alma Irene Connolly, a part interest to each; Lynne Patricia Oldfield, Australia

[21] Appl. No.: 593,816

[22] Filed: Oct. 5, 1990

[30] Foreign Application Priority Data

Oct. 5, 1989 [AU] Australia ..... PJ6702
Sep. 24, 1990 [AU] Australia ..... 63103/90

[51] Int. Cl.[5] ..... E01C 23/09
[52] U.S. Cl. ..... 404/50; 404/48
[58] Field of Search ..... 404/48, 49, 50

[56] References Cited

U.S. PATENT DOCUMENTS

| | | | |
|---|---|---|---|
| 1,629,756 | 5/1927 | White | 404/50 |
| 1,639,764 | 8/1927 | Fischer | 404/50 |
| 1,666,613 | 4/1928 | Woods | 404/50 |
| 1,770,168 | 7/1930 | Fischer | 404/50 |
| 1,819,304 | 8/1931 | Robertson | 404/50 |
| 1,978,278 | 10/1934 | O'Brien | 404/50 |
| 2,189,437 | 2/1940 | Sandell | 404/48 |
| 2,222,970 | 11/1940 | Malcolm | 404/50 |
| 2,535,135 | 12/1950 | Jacobsen | 404/50 |
| 2,798,373 | 7/1957 | Harza | 404/50 |
| 2,976,781 | 3/1961 | Heltzel | 404/48 |
| 3,057,269 | 10/1962 | Artigalas et al. | 404/50 |
| 3,276,335 | 10/1966 | Middlestadt | 404/48 |
| 3,782,846 | 1/1974 | Johnson | 404/48 |
| 4,194,282 | 3/1980 | Byrd, Jr. | 404/49 |

*Primary Examiner*—Ramon S. Britts
*Assistant Examiner*—Nancy Connolly
*Attorney, Agent, or Firm*—Larson and Taylor

[57] ABSTRACT

A concrete keyed joint is formed using a joint plate which has coplanar top and bottom sections interconnected to a parallel rearwardly spaced central section by rearwardly convergent upper and lower inclined sections and spaced pair of holes in the inclined section. Pegs or stakes support the joint plate vertically and are locked by wedges which allow vertical adjustment of the joint plate and then lock it in position. A resilient filler strip is fitted to the top of the plate to accommodate thermal expansion and contraction of the concrete slabs separated by the joint plate.

15 Claims, 4 Drawing Sheets

CONCRETE KEYED JOINTS

BACKGROUND OF THE INVENTION

1. Field of the Invention

THIS INVENTION relates to improvements in concrete keyed joints.

2. Prior Art

Because concrete undergoes thermal expansion and contraction, it is necessary to provide expansion joints or breaks in concrete slabs, footpaths and the like to at least minimise unwanted cracking in the concrete. For example, it is common practice to provide expansion joints or break lines every 1.0 to 1.5 meters along footpaths.

Keyed jointing systems have been proposed and one system is sold under the "TOBY" trade mark. While this system is preferable to laying the concrete in spaced sections and then laying the concrete in the intermediate sections separately, the system has a number of deficiencies. It is difficult to accurately align the stakes before the joint plates are positioned. If the stakes or plates are disturbed, e.g. by being stepped on by the labourers, realignment of the stakes and plates is difficult. Thirdly the joint plates must be crimped into engagement with the tops of the stakes and only the upper portions of the joint plates are anchored by the stakes until the concrete is poured. Finally, a removable cap must be removed when the concrete has at least partially set to leave the required break line.

SUMMARY OF THE INVENTION

It is an object of the present invention to overcome or at least minimise the deficiencies in known jointing systems.

It is a preferred object to provide a jointing system which is simple to manufacture and install and which is readily adjustable.

It is a further preferred object to provide a system where a resilient filler strip may be supplied on a roll and applied to the key joint plate before the concrete is laid.

Other preferred objects will become apparent from the following description.

In one aspect the present invention resides in a keyed joint assembly for concrete including:

a joint plate having substantially co-planar vertical top and bottom sections interconnected to a parallel rearwardly spaced central section by rearwardly convergent upper and lower inclined sections, a plurality of pairs of holes spaced along the plate, the holes from each pair being provided respectively in the upper and lower inclined sections in vertical alignment to each other, and a substantially horizontal top edge;

a plurality of stakes to support the joint plate substantially vertically, each stake passing through a respective pair of the vertically aligned holes; and a plurality of wedge means, each engageable between the central section of the plate and an adjacent portion of one of the stakes to releasably lock the joint plate to the respective stake.

Preferably, a resilient filler strip having an elongate-slit along its bottom face to receive and engage the top edge of the joint plate, the top face of the filler strip defining the top surface of the adjacent concrete.

In a second aspect, the present invention resides in a resilient filler strip for keyed joint plates supplied in roll form.

The joint plate may be roll-formed of sheet metal, or may be formed from Cane-ite or other compacted fibrous material, or from timber.

The stakes may comprise circular, hexagonal or like section steel rods or may be formed from sheet metal and be of substantially L-, U- or V-section or the like. Preferably each stake terminates in a point at its lower end. The pairs of holes in the plate may be circular or triangular in plan view.

Preferably each wedge is of increasing width and height from its forward end and may be provided with a plurality of spaced transverse slots or grooves for releasable locking engagement with the stakes. The wedges may be pressed from sheet metal material.

The filler strip may be formed, e.g. by extrusion, from rubber, plastics (e.g. PVC, polyethylene foam) or other resilient material.

Preferably it is supplied in the form of a roll and is cut to length and applied to the joint plates before the concrete is poured. Preferably the slit is provided centrally of the bottom face and is preferably of a depth in the range of 50–85% of the height of the strip. Preferably the depth of the slit is just less than the height of the top section of the joint plates. Preferably the slit will be held in place on the joint plate by the natural stiffness of the strip or by adhesive if required.

One or more grooves, preferably horizontal, may be provided along the side faces of the strip or the side faces may be rough surfaced to enable the strip to adhere to the concrete.

BRIEF DESCRIPTION OF THE DRAWINGS

To enable the invention to be fully understood, a number of preferred embodiments will now be described with reference to the accompanying drawings, in which.

DETAILED DESCRIPTION OF THE PREFERRED EMBODIMENTS

Figure 1:
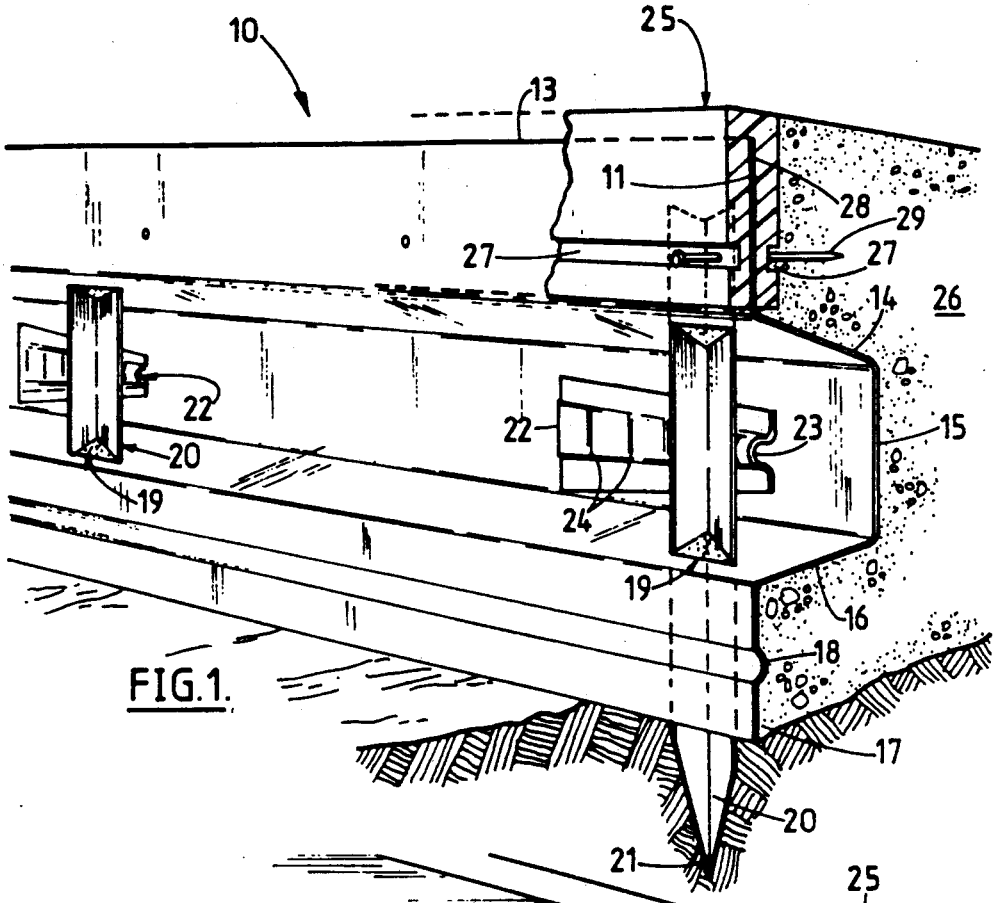
FIG. 1 is a part-sectional view showing one embodiment of the joint assembly in use.
Figure 2:
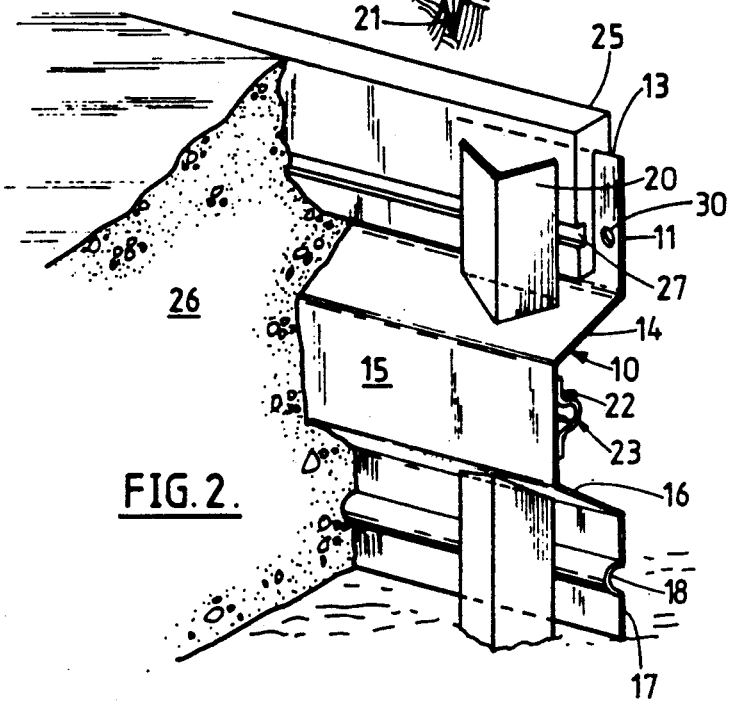
FIG. 2 is a rear view corresponding to FIG. 1.

Referring to FIGS. 1 and 2, the joint plate 10 is roll-formed from sheet metal. The top section 11 is planar and substantially vertical (and may have a folded flange (not shown)) and is terminated by a horizontal top edge 13. A rearwardly directed, inclined section 14 leads to a vertical centre section 15 parallel to the top section 11. A second inclined section 16 extends forwardly to a generally vertical, planar bottom section 17 with a longitudinal reinforcing deformation 18.

Triangular holes 19 are provided in spaced, vertically aligned pairs in the inclined sections 14, 16 and receive stakes 20.

Each stake 20 is formed from sheet metal and is substantially L- or V-shaped in end view. The lower end of the stakes terminates in a point 21.

Wedges 22, also formed of sheet metal, have central ribs 23 of increasing height and width from the nose of the wedges and transverse slots or grooves 24 are produced on the ribs.

In use, the joint plate 10 is positioned along the joint line and the stakes 20 are driven through the holes 19. The joint plate is brought the correct vertical alignment and the wedges 22 are inserted to lock the plate 10 to the stakes 20.

If the joint plate 10 should be disturbed before the concrete is poured, the wedges 22 can be removed (or released), the joint plate 10 realigned and the wedges 22 re-engaged.

A resilient filler strip 25 is fitted to the joint plate 10 before the first concrete slab 26 is poured.

The resilient filler strip 25 is extrusion moulded from suitable rubber or plastics material, is supplied in a roll and cut to length. The filler strip has a horizontal groove 27 in each side face to key the filler strip 25 to the concrete. A vertical slit 28, centrally in the filler strip and open to its bottom face, extends to a depth of approximately 80% of the height of the filler strip, the depth of the slit 28 being just less than the height of the top section 11 of the joint plate.

When the filler strip is applied to the joint plate, the slit 28 is opened by the thicker top section 11 of the joint plate (and any turned-over flange thereon) and the resilience of the filler strip material secures the filler strip in place.

When the joint plate 10 (with its filler strip 25) has been positioned, the concrete slab 26 can be poured on one side and the top face of the resilient filler strip 25 can support one end of the concrete screed. The slab 26 on the second side can then be poured without having to remove the joint plate, the stakes and the wedges.

Fixing pins 29 can be passed through the filler strip 25 and holes 30 in the top section 11 of the joint plate 10. The fixing pins 29 deep in the concrete slab 26 mean that the filler strip 25 is very resistant to pulling out of the concrete.

Figure 2A:
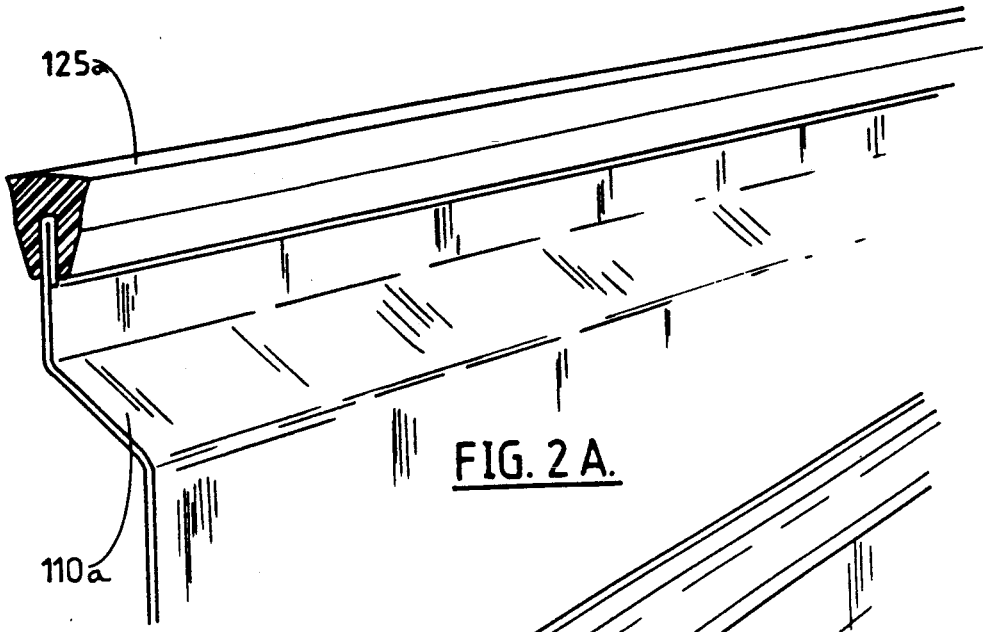
FIG. 2A is a part sectional view showing a removable PVC strip.

Referring to FIG. 2A, the filler strip 125*a*, on joint plate 110*a*, is extruded from PVC and is designed to be removed after the concrete slabs 26 on each side of the joint plate 110*a* have cured, and the resultant void is filled with a sealant.

Figure 2B:
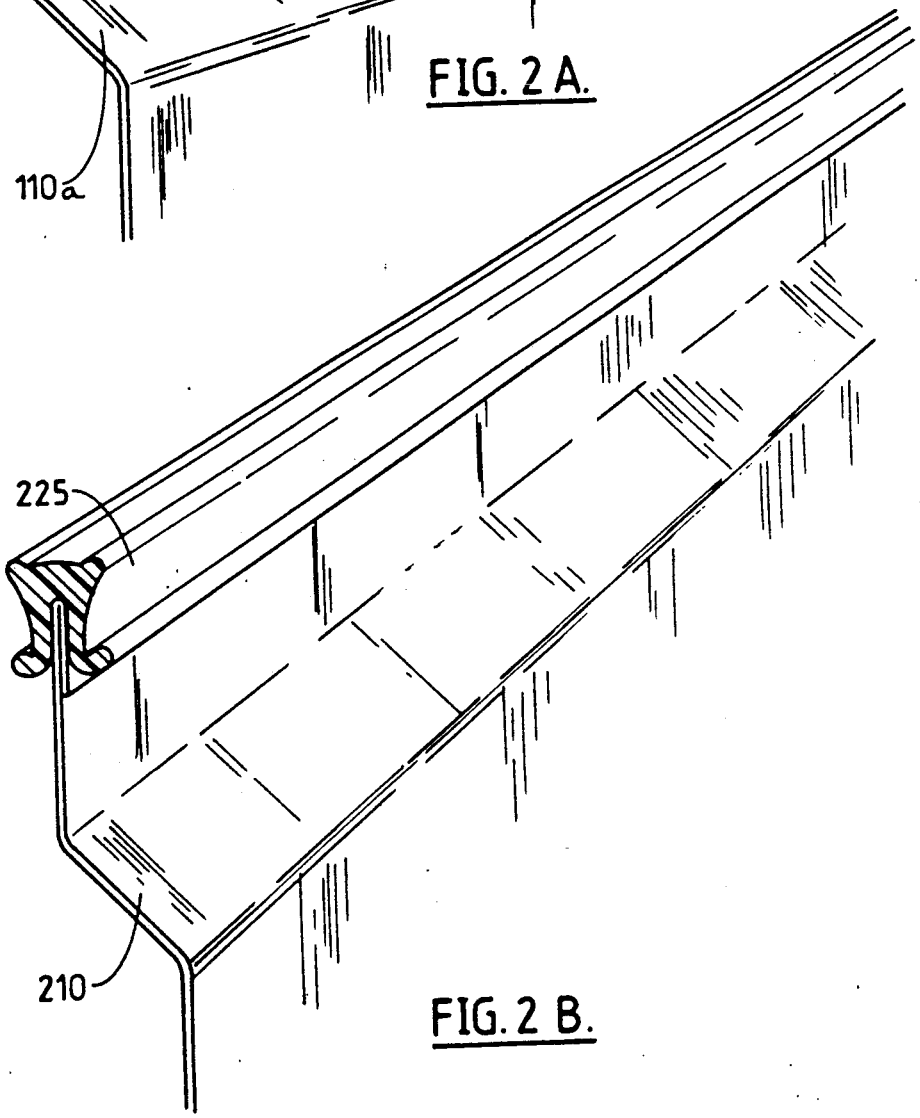
FIG. 2B is a part sectional view of a retained PVC strip.

The filler strip 225, on joint plate 210 (see FIG. 2B) is also extruded from PVC but is designed to be retained on the joint plate 210. This filler strip 225 is designed for joint spacings around, e.g. 3 meters, or where drying and shrinkage is not excessive.

Figure 3:
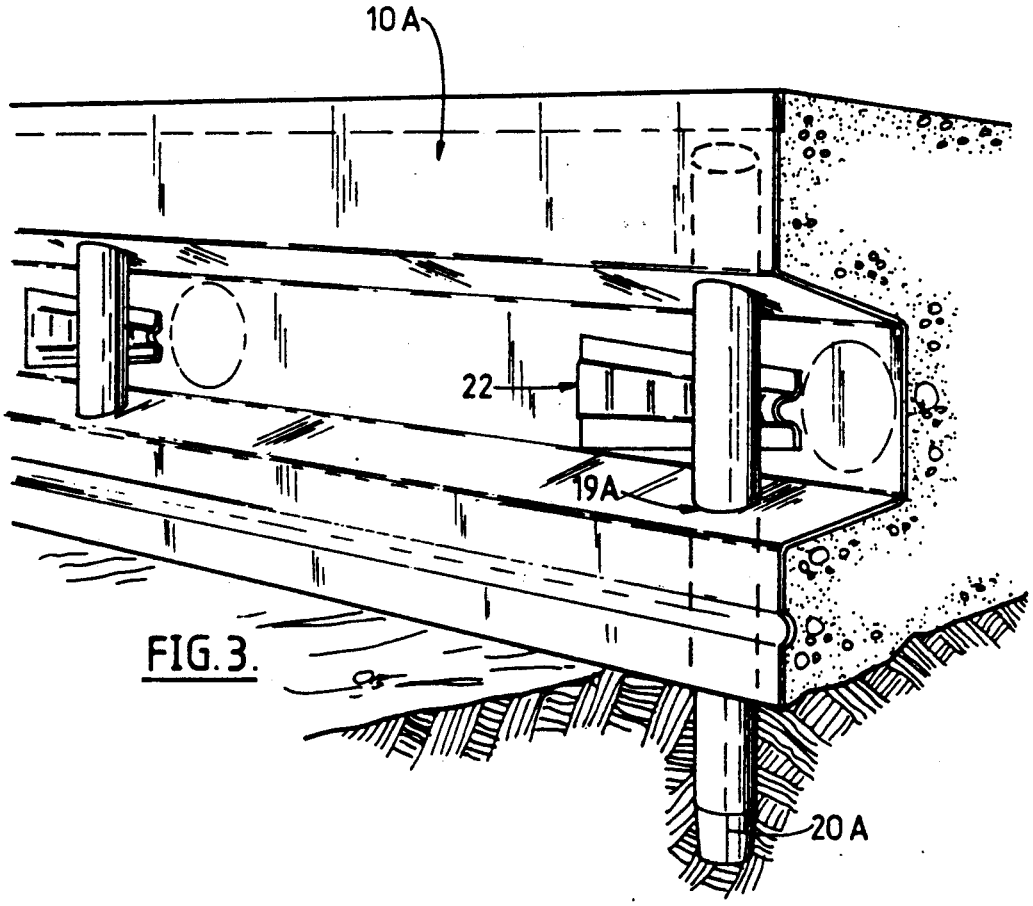
FIG. 3 is a front view corresponding to FIG. 1 of a fourth embodiment.

Referring now to FIG. 3 which is a front view of a fourth embodiment (corresponding to FIG. 1). The first joint plate 10A is generally arranged as for the joint plate 10 of the first embodiment (of FIGS. 1 and 2) except that the holes 1A are circular to receive steel rods 20A as the stakes. The rods 20A engage the wedges 22 in the manner hereinbefore described and the setting up of the joint plate 1A is as for joint plate 10.

Figure 4:
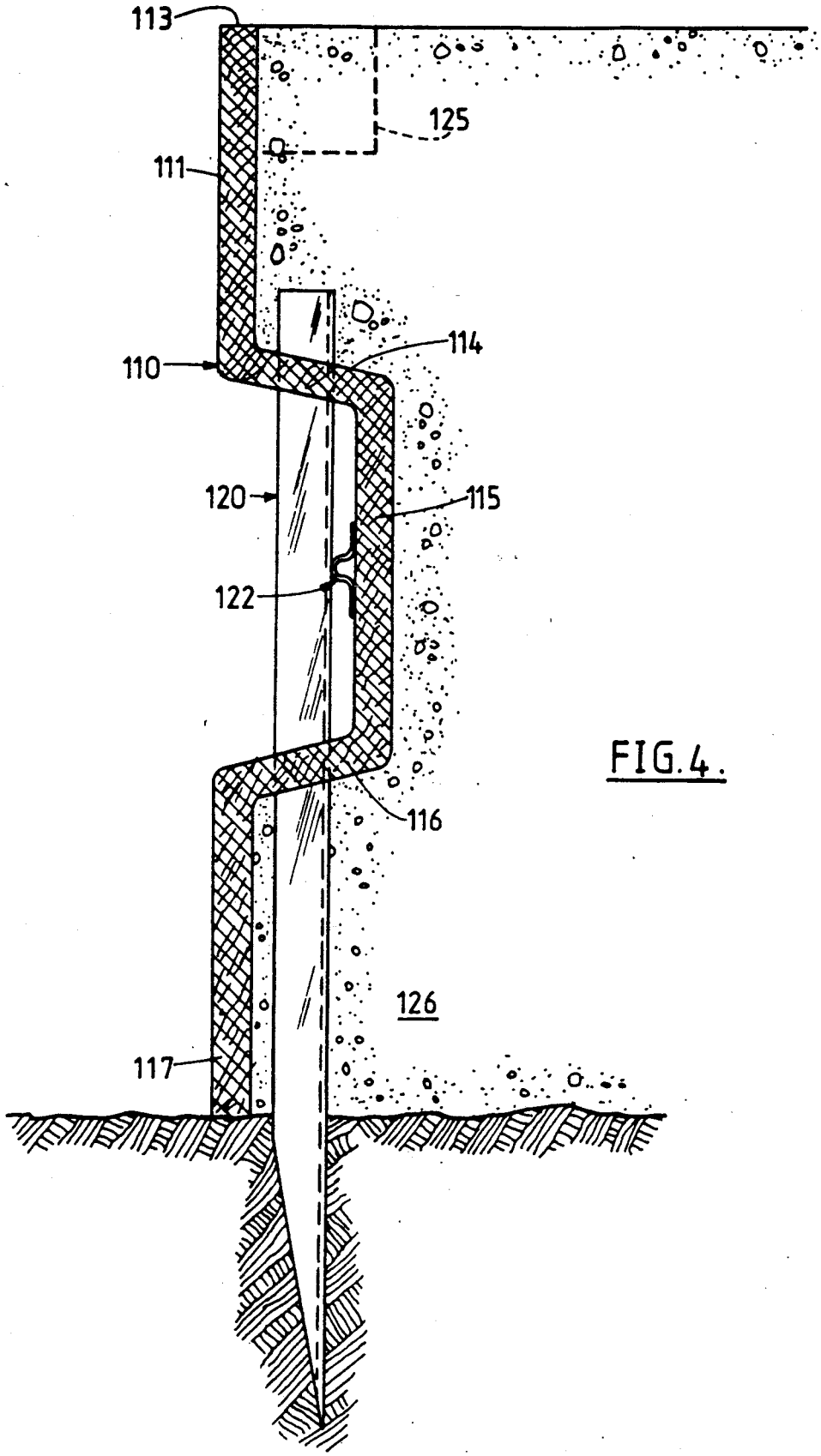
FIG. 4 is a sectional side view of a fifth embodiment.

Referring to FIG. 4, this shows a fifth embodiment where the joint plate 110 is formed of Cane-ite or other suitable composite fibrous material. The stakes 120 and wedges 122 operate in the manner hereinbefore described.

A resilient expansion strip 125 may be provided on the rear of the top section 111. However, the resilience of the material of the joint plate 110 may be sufficient to accommodate the thermal expansion and contraction of the concrete slabs 126.

It will be readily apparent to the skilled addressee that the present invention enables concrete keyed joints to be easily formed and that simple and efficient alignment, and re-alignment of the joint plates is possible with the stakes and wedges.

The supplying of the resilient filler strips 25, 125, 125*a*, 225 in roll form ensures ease of handling the strip and as the strip extends to both sides of the joint plate 10, 110, 110*a*, 210 thermal expansion of the concrete slabs 26, 126 is compensated on both sides, and not just one side, of the joint plates 10, 110, 110*a*, 210.

Various changes and modifications may be made to the embodiment described and illustrated without departing from the scope of the present invention defined in the appended claims.

We claim:

1. A keyed joint assembly for concrete including a joint plate having substantially coplanar vertical top and bottom sections interconnected to a parallel rearwardly spaced central section by rearwardly convergent upper and lower inclined sections, a plurality of pairs of holes spaced along the plate, the holes from each pair being provided respectively in the upper and lower inclined sections in vertical alignment to each other, and a substantially horizontal top edge; a plurality of stakes to support the plate substantially vertically, each stake passing through a respective pair of the vertically aligned holes; and a plurality of wedge members, each engageable between the central section of the joint plate and an adjacent portion of one of the stakes to releasably lock the joint plate to the respective stake, each said wedge member being formed of sheet metal and being of increasing width and height from its forward end and including a plurality of spaced transverse grooves or slots for releasably locking engagement with a respective stake.

2. A joint assembly according to claim 1 wherein:
a resilient filler strip having an elongate slit along its bottom face is provided to receive and engage the top edge of the joint plate, the top face of the filler strip defining the top surface of the adjacent concrete.

3. A joint assembly according to claim 2 wherein:
the filler strip is formed by extrusion from rubber, plastics or other resilient material.

4. A joint assembly according to claim 3 wherein:
the plastics material is PVC or polyethylene foam.

5. A joint assembly according to claim 2 wherein:
the filler strip is supplied in the form of a roll and is cut to length and applied to the joint plate before the concrete is poured.

6. A joint assembly according to claim 2 wherein:
the slit is provided centrally in the bottom face and is of a depth in the range of 50% to 85% of the height of the strip, the depth being less than the height of the top section of the joint plate.

7. A joint assembly according to claim 6 wherein:
the top section of the joint plate is held in the slit by the stiffness of the strip or by adhesive.

8. A joint assembly according to claim 2 wherein:
at least one horizontal groove is provided along the side faces of the strip or the side faces of the strip are rough surfaced to enable the strip to adhere to the concrete.

9. A joint assembly according to claim 2 wherein:
pins pass horizontally through the strip and holes in the top section of the joint plate to retain the strip on the joint plate.

10. A joint assembly according to claim 2 wherein the strip is removable from the joint plate after the concrete is poured, and the resultant void is filled with a sealant.

11. A joint assembly according to claim 1 wherein:

a resilient expansion strip is provided on the rear face of the top section of the joint plate to accommodate the thermal expansion of the concrete slabs.

12. A joint assembly according to claim 1 wherein:

the joint plate is roll-formed of sheet metal.

13. A joint assembly according to claim 1 wherein:

the joint plate is formed of compacted fibrous material.

14. A joint assembly according to claim 1 wherein:

the stakes are circular section steel rods; each stake terminates in a point at its lower end; and the pairs of holes in the joint plate are circular in plan view.

15. A joint assembly according to claim 1 wherein:

the stakes are formed of sheet metal of substantially V-section; each stake terminates in a point at its lower end; and the pairs of holes in the joint plate are triangular in plan view.

* * * * *